US006880358B2

(12) United States Patent
Lucas et al.

(10) Patent No.: US 6,880,358 B2
(45) Date of Patent: Apr. 19, 2005

(54) ICE AND ICE/BEVERAGE DISPENSERS

(75) Inventors: Alan S. Lucas, Evansville, IN (US); Wm. Derek Slone, Charlestown, IN (US); M. Scott Bennett, Louisville, KY (US); Hershel E. Fancher, Charlestown, IN (US)

(73) Assignee: Manitowoc Foodservice Companies, Inc., Sparks, NV (US)

( * ) Notice: Subject to any disclaimer, the term of this patent is extended or adjusted under 35 U.S.C. 154(b) by 0 days.

(21) Appl. No.: 10/389,681

(22) Filed: Mar. 14, 2003

(65) Prior Publication Data

US 2003/0230108 A1 Dec. 18, 2003

Related U.S. Application Data

(60) Provisional application No. 60/365,233, filed on Mar. 16, 2002.

(51) Int. Cl.[7] ..... F25C 5/14
(52) U.S. Cl. ..... 62/344; 62/389; 222/146.6
(58) Field of Search ..... 62/344, 264, 389, 62/390; 222/146.6

(56) References Cited

U.S. PATENT DOCUMENTS

| | | | | |
|---|---|---|---|---|
| 3,995,441 A | | 12/1976 | McMillin | |
| 4,218,014 A | | 8/1980 | Tracy | |
| 4,641,763 A | * | 2/1987 | Landers et al. | 222/129.1 |
| 4,658,988 A | | 4/1987 | Hassell | |
| 4,678,104 A | * | 7/1987 | Pritchett | 222/146.6 |
| 4,969,576 A | | 11/1990 | Merrill et al. | |
| 5,104,007 A | | 4/1992 | Utter | |
| 5,115,942 A | | 5/1992 | Merrill et al. | |
| 5,228,312 A | | 7/1993 | Williams | |
| 5,230,448 A | * | 7/1993 | Strohmeyer et al. | 222/643 |
| 5,335,819 A | | 8/1994 | Martin | |
| 5,392,960 A | | 2/1995 | Kendt et al. | |
| 5,560,221 A | * | 10/1996 | Snelling et al. | 62/344 |
| 5,660,307 A | | 8/1997 | Schroeder et al. | |
| 5,765,726 A | | 6/1998 | Jones | |
| 5,768,905 A | * | 6/1998 | Oh | 62/264 |
| 5,797,514 A | | 8/1998 | Twiggar et al. | |
| 5,829,646 A | | 11/1998 | Schroeder et al. | |
| 5,884,813 A | | 3/1999 | Bordonaro et al. | |
| 5,901,884 A | | 5/1999 | Goulet et al. | |
| 5,947,342 A | * | 9/1999 | Song | 222/413 |

* cited by examiner

*Primary Examiner*—William E. Tapolcai
(74) *Attorney, Agent, or Firm*—Brinks Hofer Gilson & Lione

(57) ABSTRACT

An apparatus for a countertop ice dispenser or ice and beverage dispenser is made from a single piece plastic ice bin. Parts for the dispenser are assembled into sub-assemblies before final assembly. The ice bin may be made by a rotomolding process. This uses relatively inexpensive molds with reasonable control over the thickness of the resulting bin, while allowing up to 0.005" of variation per inch of length in the overall size of the ice bin. The resulting ice bin has hollow walls that can be filled with insulating foam. An attractive dispenser may be assembled from such an ice bin, with metal panels and a plastic base. If a combined ice/beverage dispenser is desired, a cold plate and dispensing valve may be included. The plastic base and a plastic drain pan have integral attachments that mate for assembly. The dispenser may also be easily disassembled for repair.

29 Claims, 15 Drawing Sheets

ICE AND ICE/BEVERAGE DISPENSERS

RELATED APPLICATIONS

This application claims the benefit of the filing date under 35 U.S.C. § 119(e) of Provisional U.S. Patent Application Ser. No. 60/365,233, filed on Mar. 16, 2002, which is hereby incorporated by reference in its entirety.

BACKGROUND

Ice and soft drink dispensers are widely used to dispense drinks in a variety of establishments. Fast-food outlets, roadside convenience stores, re-fueling stations, and cafeterias are examples of locations where there is a high volume consumption of soft drinks. Of course, dispensers used in such locations require good performance, such as good thermal insulation so that a beverage is dispensed to consumers' liking, that is, as cold as the ice and thermal insulation will allow. Performance characteristics may also include overall cooling capacity of the dispenser, insulation value of the dispenser, that is, its ability to maintain ice and cold drink temperatures, and the ability of the dispenser to maintain adequate carbonation volumes. Because of the high volume, it is also important for these dispensers to be made for low cost, so that they will continue to be available, even as costs of labor, costs of materials, and other costs continue to rise. Costs of ownership may also include repairs costs, whether at the factory or on-site, and refurbishments necessary to maintain performance or appearance.

A variety of methods have been used to keep costs low in beverage dispensers. These include using assemblies and subassemblies, such as revealed in U.S. Pat. No. 5,901,884, or using foam-in-place methods of assembly, as revealed in U.S. Pat. Nos. 5,335,819 and 5,392,960, and PCT Patent Publication No. WO 94/11297. Using foam-in-place methods is an attractive method of manufacturing, since the outer skin or skin panels of the dispenser itself may be the "tool" used to limit and form the foam, which then surrounds and insulates very efficiently. This step, however, may also adhere the foam to internal parts and the outer skin of the dispenser, thus making disassembly very difficult, if not impossible. Repair of the skins may be desired, for instance when the dispensers are subject to gouges, or when caustic or harmful substances come in contact with the skins and deface or mar them.

Besides these disadvantages, the dispensers themselves are typically made of metal skins and bottoms, which are subject to corrosion, and which also may scratch or mar the surfaces onto which they are placed. What is needed is a dispenser for ice and beverages that overcomes these disadvantages. Such dispensers will preferably not mar or scratch counter surfaces or tabletops in food-service areas. Such a dispenser is desirably made in such a fashion that it is repairable when a surface panel is gouged or otherwise defaced. The dispenser will ideally also have a low cost of manufacture.

BRIEF SUMMARY

In order to address these deficiencies of the prior art, dispensers for ice, and dispensers for ice and beverages combined, have been invented. There are numerous separate embodiments of the invention. Each of these embodiments may be placed directly on a food-service surface, such as a countertop or customer self-service area. Alternatively, each may mount on legs rather than directly on a surface. Each embodiment may also form a combination with an ice-making machine mounted atop an ice bin included in the dispenser. Alternatively, ice may be added manually to the ice bin. One embodiment of the invention is a countertop dispenser. The dispenser comprises a single-piece plastic ice bin and an agitator and motor for agitating ice within the ice bin. The dispenser also comprises an ice chute that mounts to the ice bin. A housing detachably mounts with fasteners to the plastic ice bin.

Another embodiment of the invention is an ice and beverage dispenser. The ice and beverage dispenser comprises a single-piece ice bin and a housing to which the ice bin is detachably mounted. The dispenser also comprises an agitator and motor for agitating ice within the ice bin, and an ice chute that mounts to the ice bin. The dispenser also comprises a cold plate mounted under the ice bin, the cold plate having a plurality of beverage component coils for heat exchange with the ice in the ice bin. There is also a plurality of dispensing valves in fluid communication with the beverage component coils for dispensing a beverage.

Another embodiment of the invention is a method of manufacturing a dispenser. The method comprises roto-molding an ice bin. The method then comprises assembling the ice bin to a base and then detachably mounting housing panels to the base and to the ice bin. The housing panels and base fit the ice bin. The method also includes mounting a motor and an agitator to the ice bin and mounting an ice chute to the ice bin. The ice chute is preferably assembled into a sub-assembly before mounting.

Another embodiment of the invention is a dispenser comprising a single-piece ice bin formed as a monolithic piece. The dispenser further comprises an agitator and a motor for agitating ice within the ice bin, and a housing detachably mounted with fasteners to the plastic ice bin. Yet another embodiment of the invention is a dispenser comprising a plastic ice bin formed with hollow walls into which foam is later injected. The dispenser also comprises an agitator and motor for agitating ice within the ice bin and a housing detachably mounted with fasteners to the plastic ice bin. Any of the embodiments of ice dispensers can be made into a combined ice and beverage dispenser by adding a cold plate and at least one dispensing valve.

These and other features and advantages of the invention will become apparent upon review of the following detailed description of the presently preferred embodiments of the invention, taken in conjunction with the appended drawings.

DETAILED DESCRIPTION OF THE DRAWINGS AND THE PRESENTLY PREFERRED EMBODIMENTS

The present invention is embodied primarily in an ice dispenser and in a dispenser for both ice and one or more beverages. The invention also involves assemblies and methods used to manufacture and assemble the parts of the dispensers. As will be shown below, the dispensers may advantageously be assembled from subassemblies, with final assembly (and disassembly) being relatively simple. Many subassemblies are common to different dispenser embodiments. Embodiments of the invention thus include ice dispensers and ice/beverage dispensers. These embodiments may be combined with a top-mounted ice-making machine, or may alternatively receive ice by manual or automated transfer to an ice bin within the ice or ice/beverage dispenser. Any of these embodiments may also be equipped with legs to rest above a countertop or food-preparation surface, or may rest directly on the countertop or other food-preparation surface.

Figure 1:
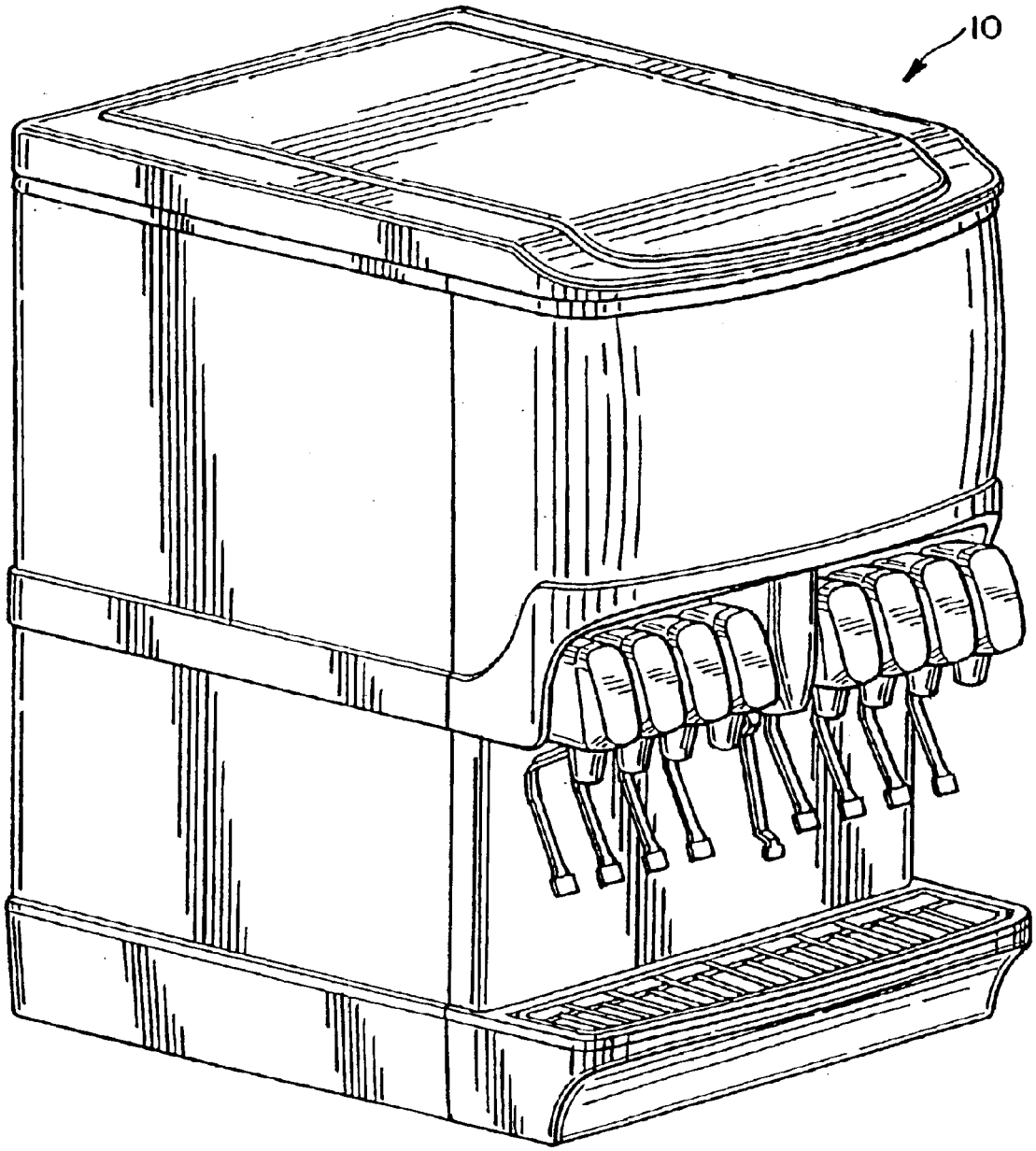
FIG. 1 is a perspective view of a first embodiment of an ice/beverage dispenser of the present invention.
Figure 2:
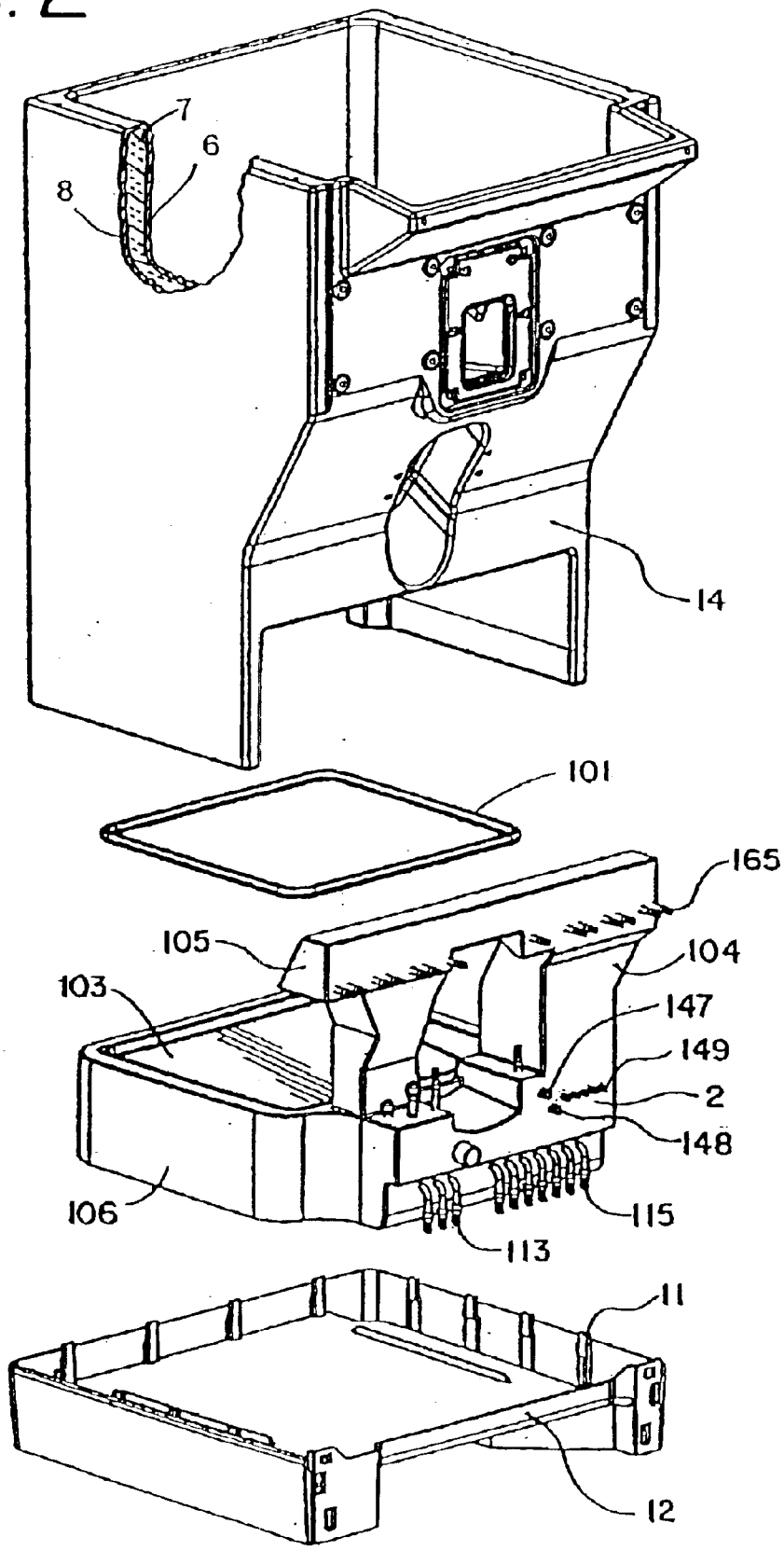
FIG. 2 is an exploded view of an ice/beverage dispenser assembly used in the first embodiment of an ice/beverage dispenser.

A first embodiment of a dispensing machine 10 for ice and beverages is shown in FIG. 1. Important details of the dispenser, as shown in the exploded view of FIG. 2, include a single-piece ice bin 14, cold plate 2, and base 12. Ice bin 14 interfaces with cold plate 2 via gasket 101. Ice bin 14 is formed with hollow walls which are later filled with foam. The ice bin 14 comprises an inner wall 6, a foam layer 7, and an outer wall 8. Cold plate 2 mounts atop base 12. Cold plate 2 may have a lower portion 103 in contact with ice, and may also have an intermediate portion 104 and a tower portion 105. The cold plate 2 may be a cast aluminum structure with cooling coils for beverage components, such as syrup and water, embedded within the cold plate. The cold plate may also have a removable exterior foam insulation layer 106 covering most of the aluminum structure, except for the upper flat surface of lower portion 103 (shown with shading) where the ice itself may rest.

The cold plate may mount upon base 12. Cold plate 2 may have many coils embedded within, and may have inlets 113 for water cooling coils and inlets 115 for syrup or other beverage cooling coils, in the lower portion 103 of cold plate 2. Also depicted are chilled carbonated water outlet 147, chilled water outlet 148, and manifold outlets 149 within the intermediate portion 104 of the cold plate. In the embodiment shown, the cold plate has eight outlet pairs 165 in the top portion 105 of the cold plate. Each outlet pair 165 connects with a source of water and a source of syrup. These outlets are subsequently connected to dispensing valves for proportioning and mixing the syrup and water. In some embodiments, water-only may be dispensed, and in some embodiments, a pre-mixed or single-component beverage (e.g. tea) may be dispensed.

Figure 3:
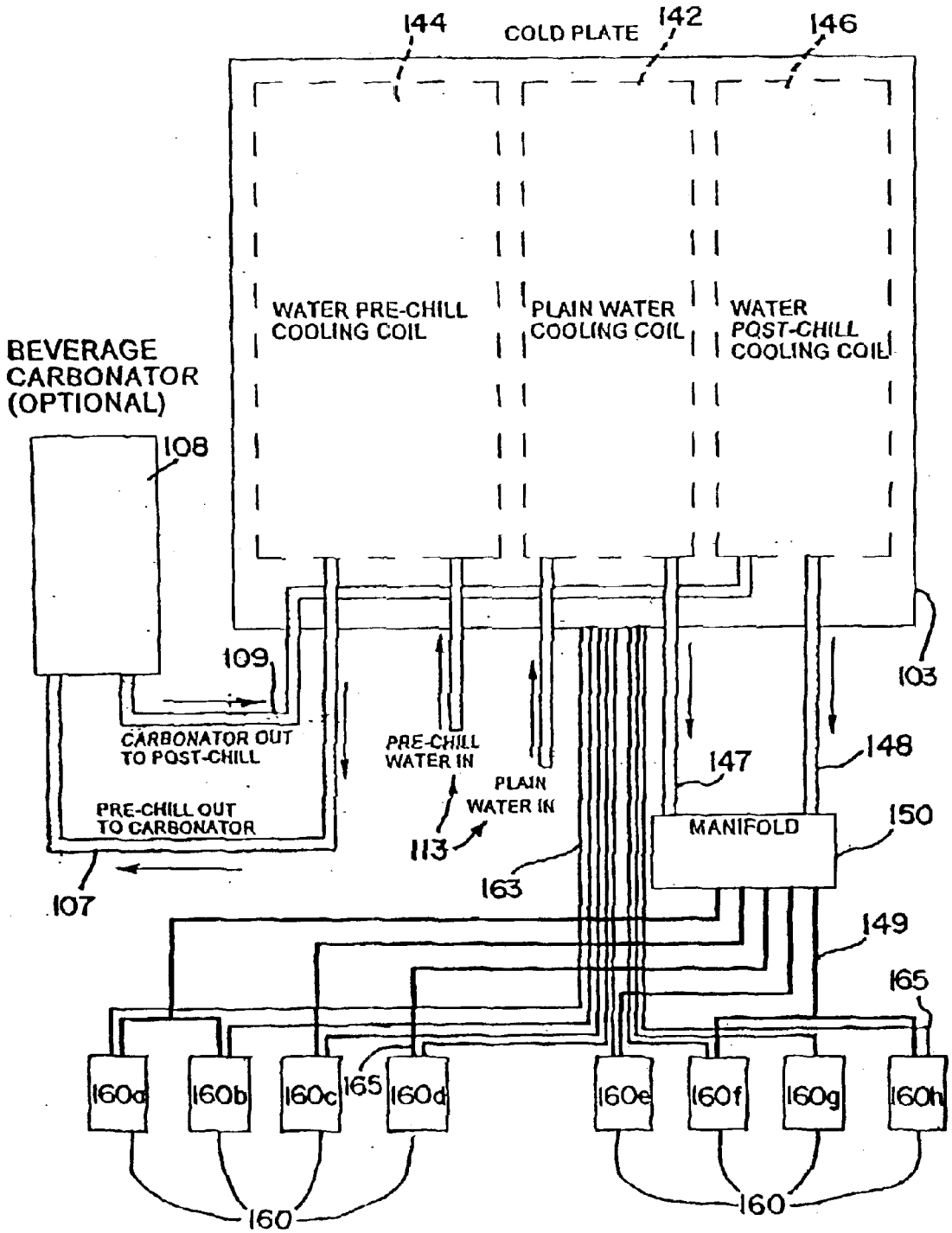
FIG. 3 is a diagrammatic view of the cold plate and associated components of the first embodiment of the ice/beverage dispenser.

The cold plate is detailed diagrammatically in FIG. 3. The cold plate bottom portion 103 is cooled by melting ice in the bottom of the ice dispenser. Heat is thus transferred to the ice from components of the beverages that are dispensed by the ice/beverage dispenser. Heat is transferred by passing water, beverage or soda syrup through beverage component cooling coils embedded within the cold plate. In one embodiment, the cold plate is a cast aluminum structure with internal cooling coils to cool the syrup or beverage, including several coils for beverage or syrup (not shown), coil 142 for tap water, and coil 144 for carbonated water. In one embodiment, the cold plate may be about two inches thick, and the water cooling coils are embedded within an upper part of the cold plate portion 103, while the syrup or beverage cooling coils are embedded within a lower part. In post-mix beverages, water and syrup are typically mixed in a ratio of about five to one, wherein the water requires significantly more cooling than the syrup. Hence, a preferred embodiment is to have the water cooling coils closer to the ice providing a heat sink for the dispenser, while the syrup cooling coils may be further away from the ice. The dispenser includes outlet valves 160*a*–160*h*.

In operation, tap water may flow into coil 142 embedded within the cold plate, and may flow out through line 147 to a manifold 150 for dispensing. In a similar manner, pre-chill water may flow into coil 144 embedded within the cold plate, and may flow out through line 107 to a carbonator 108, and back through line 109 to a post-chill coil 146 also within the cold plate. Chilled carbonated water leaves the cold plate through line 148 to manifold 150. The carbonator 108 is preferably maintained in a vertical orientation and provided with a source of carbon dioxide for carbonating water. The source of carbon dioxide may be a local tank or a remote tank plumbed to the carbonator.

Manifold 150 has been described previously in U.S. patent application Ser. No. 09/993,934, assigned to the assignee of the present invention, and which is hereby incorporated by reference. The manifold allows selection of either non-carbonated water from line 147 or carbonated water from line 148 to any of a plurality of outlets 149 of the manifold, allowing a user to route carbonated water for carbonated soft drinks while routing non-carbonated water for water-only or non-carbonated drinks, such as lemonade. In the embodiment shown, the manifold is located near the cooling coils, and water or carbonated water is routed from lines 147 and 148 to the manifold outlets 149. The manifold outlets 149 may be inlets for more cooling coils (not shown) embedded within the central and upper portions 104, 105 of cold plate 102. Cooling coils for beverages or syrup terminate in lines 163 routed to outlet pairs 165 and block valves 162 (shown in FIG. 4, but not shown in FIG. 3 for the sake of clarity). In the embodiments shown, dispensing valves 160*a* and 160*b* may receive non-carbonated water, for instance for water only valve 160*a* or for mixing lemonade in valve 160*b*. When valve 160*a* is used for water only, the syrup line is left in place, but no syrup source is attached. Valve 160*g* may be receiving a single-component beverage or pre-mix, such as iced tea.

Figure 4:
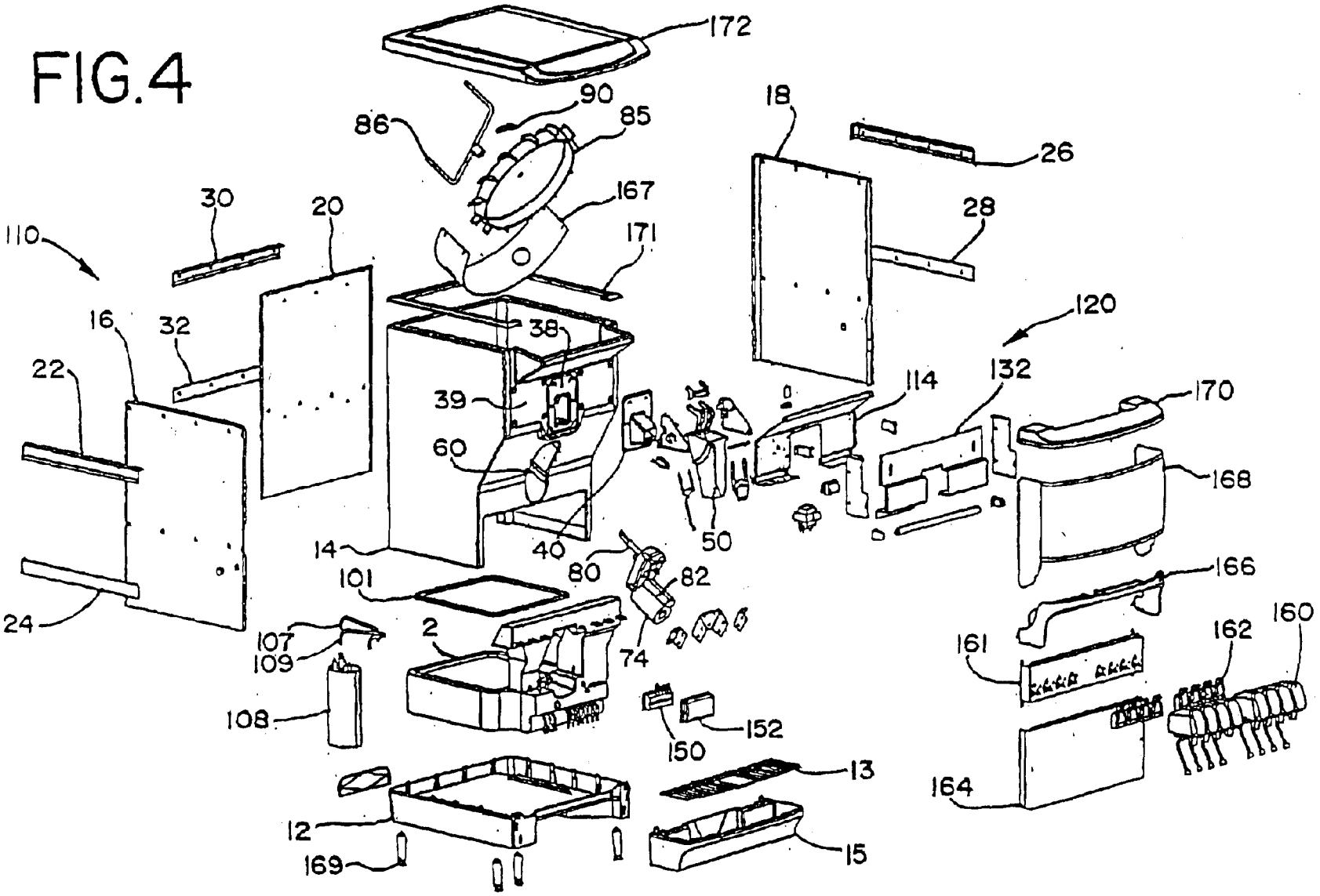
FIG. 4 is an exploded view of a second embodiment of the ice/beverage dispenser.

Another embodiment of an ice/beverage dispenser 110 is mounted on legs 169, as shown in FIG. 4. Dispenser 110 includes all the components used in dispenser 10. In this embodiment, the dispenser dispenses both ice and a beverage and is mounted on legs 169. The dispenser 110 is equipped with a cold plate 102 mounted under ice bin 14 through gasket 101. Ice is loaded manually into the ice bin 14 through the top, which is protected by lid 172. Ice chute 40 mounts to boss 38 and rocking chute 50 mounts to the ice chute for dispensing ice. Lighting assembly 120 mounts to the front of the ice bin through mounting boss 39. Motor 74 mounts to boss 60 and operably connects to paddlewheel 85 and agitator 86 via shaft 80 and pin 90.

Carbonator 108 may be positioned vertically within the ice bin 14 and connected via lines 107 and 109 to the cold plate 2. The carbonator does a better job of dissolving carbon dioxide gas into water when it is in a vertical orientation, rather than in a horizontal orientation. Not shown is a connection of the carbonator to an external source of carbon dioxide. Manifold 150 may use a thermoformed insulation cover 152 to prevent sweating on the exterior of the manifold. The upper portion of the cold plate may mount a valve mounting cap 161, block valves 162 and mixing or dispensing valves 160 for dispensing a beverage. A splash panel 164 may be used between the cold plate and the valves 160, and above grid 13 and drain pan assembly 15.

The front of the dispenser may also mount a fascia bottom 166 and a back-lit front panel 168 for the dispenser, topped by a fascia top 170. In a preferred embodiment, the lid 172, fascia top 170 and fascia bottom 166, and the base 12 and drain pan assembly 15, are molded from the same material, or in the same color, as trim strips 22, 24, 26, 28, 30 and 32, forming bands of color at the bottom, middle, and top of the dispenser. These bands may be colored distinctively, such as a black color, for contrast with the silvery appearance of stainless steel panels 16,18 and 20. In addition to the components mentioned above, the dispenser may also incorporate a liner 167 for paddle wheel 85 within the ice bin. The liner helps guide the ice as the agitator rotates and helps to reduce the amount of crushed ice. It may also separate the food zone (dispensable ice) from the splash zone (cold plate area) for better sanitation.

Figure 5A:
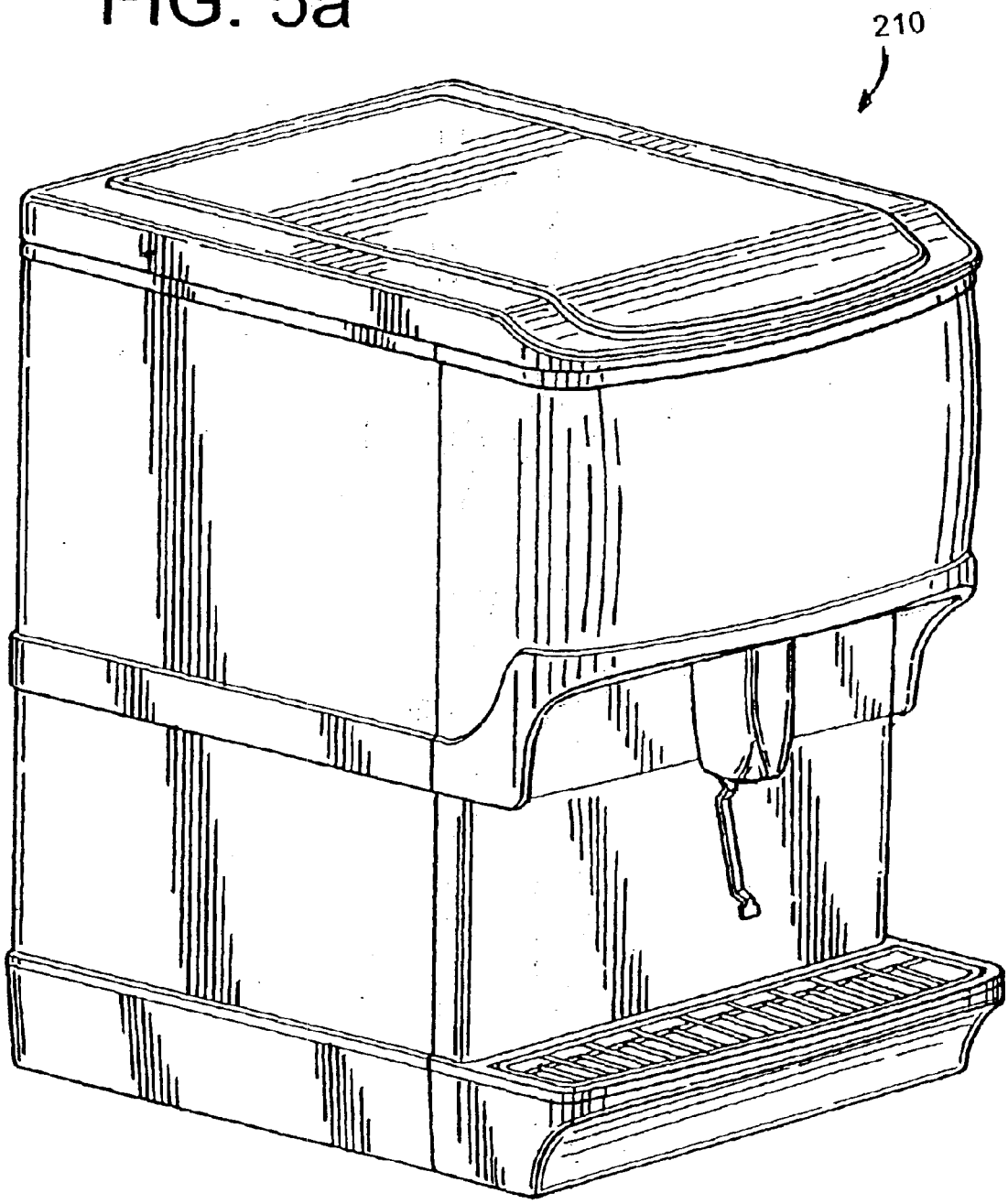
FIG. 5*a* is a perspective view of a first embodiment of an ice dispenser of the present invention.
Figure 5B:
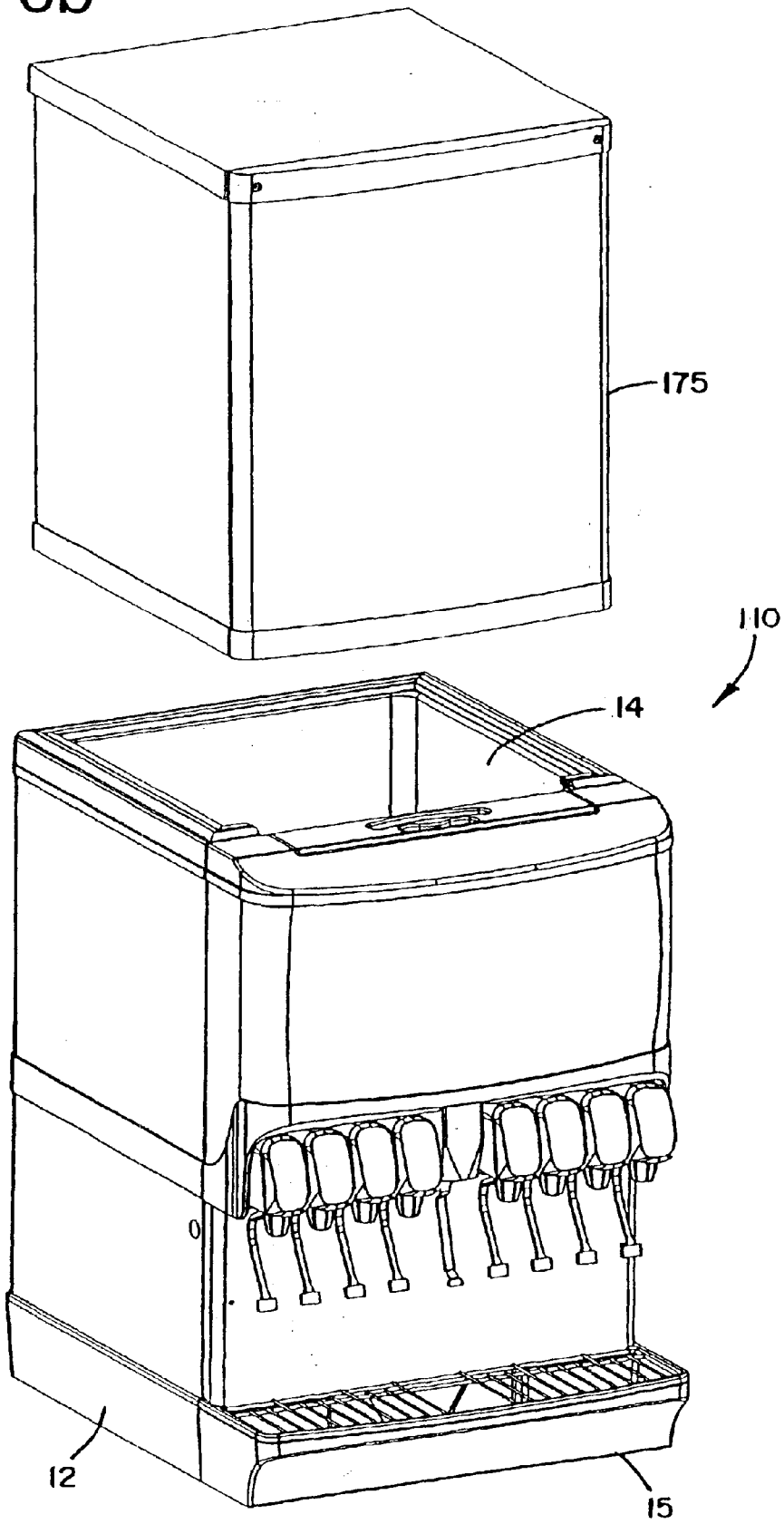
FIG. 5*b* is an exploded view of a combination of an ice/beverage dispenser of FIG. 1, having an ice-making machine atop the dispenser.

Another embodiment of an ice and beverage dispenser is shown in FIG. 5*b*. The embodiment is a combination of ice cuber 175 assembled in the top portion of the ice/beverage dispenser 110 of FIG. 4. Ice made by the cuber 175 falls into the ice bin 14 and rests atop a cold plate (not shown), supported by base 12 with drain pan 15. In other embodiments, ice may be added manually to the ice bin, while in this embodiment, water is supplied to the ice cuber, which then makes ice, preferably by a fractional-freezing process. The use of such ice makers using a cool vapor defrost method and apparatus is described in U.S. Pat. No. 6,196,007, ICE MAKING MACHINE WITH COOL VAPOR DEFROST, assigned to the assignee of the present application and hereby incorporated by reference. Ice-making machines made according to this patent may require less space in customer service areas compared to conventional ice-making machines. An example of a compact ice making machine using a further advanced method and apparatus is disclosed in U.S. patent application Ser. No. 09/910,437. This application is entitled COMPACT ICE MAKING MACHINE WITH COOL VAPOR DEFROST and is assigned to the assignee of the present invention, and which is hereby incorporated by reference.

Figure 7:
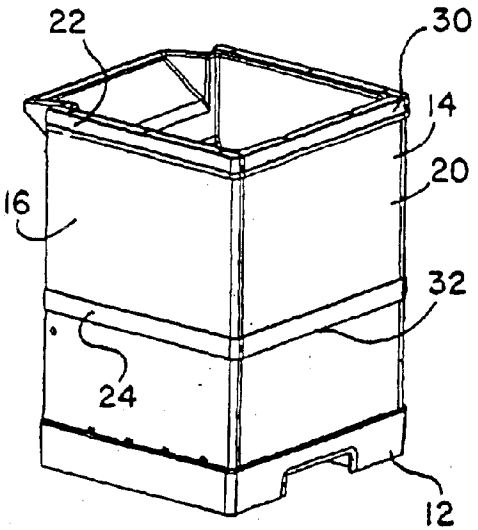
FIG. 7 is an assembled view of the ice bin and housing of FIG. 6.
Figure 6:
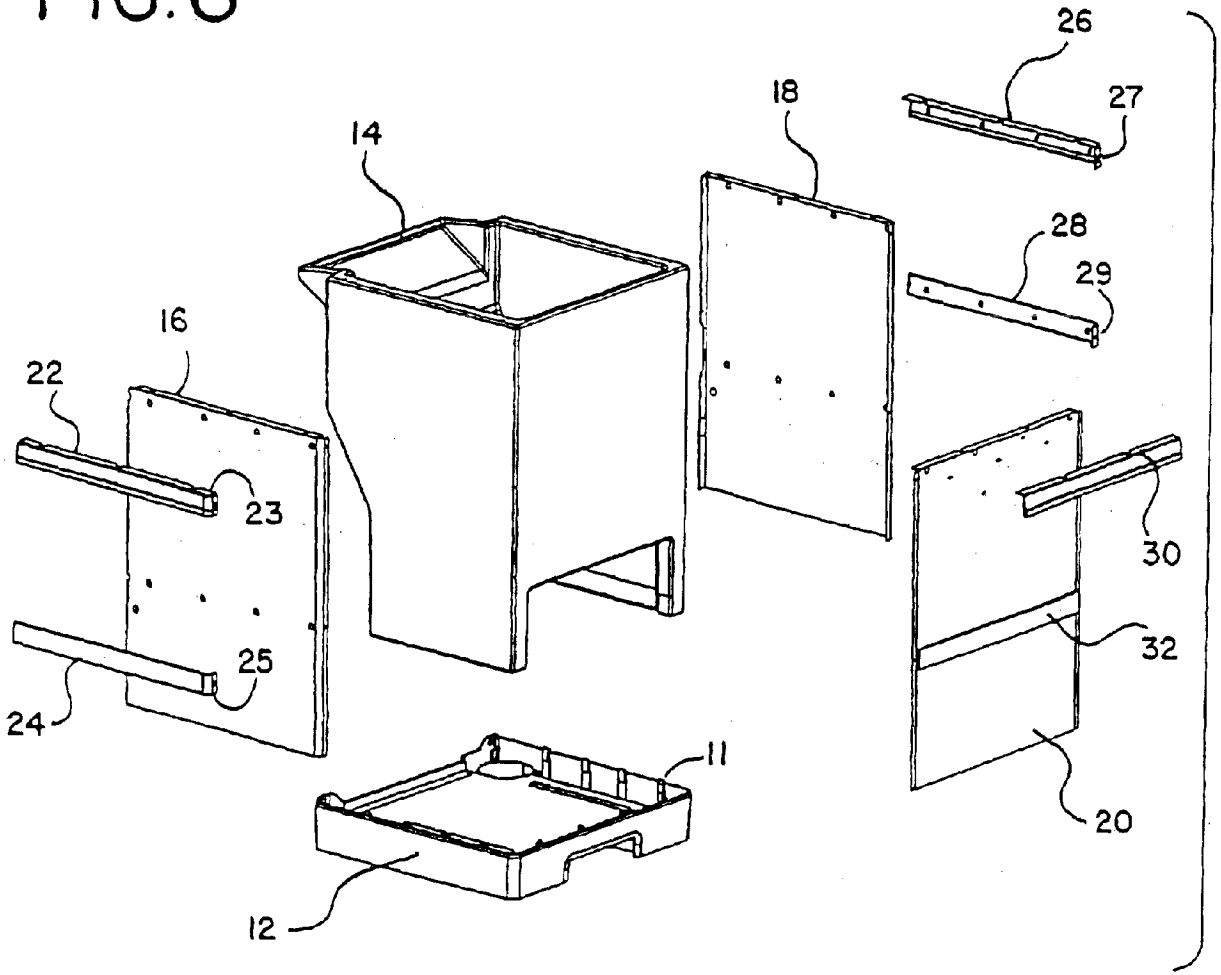
FIG. 6 is an exploded view of an ice bin and housing used in the dispenser of FIG. 5*a*.

Many of the components used to make the ice and beverage dispensers 10,110 may be used to make ice dispenser 210, shown in FIG. 5*a*. Many parts are given the same reference numerals as identical parts used in the other dispensers. Components of ice dispenser 210 include an ice bin and housing assembly, as shown in FIGS. 6 and 7. This assembly, which is also used in dispensers 10 and 110, includes base 12, ice bin 14, left side panel 16, right side panel 18 and rear panel 20. Ice bin base 12 also has tabs 11 for placement of the skin panels. The slots formed by the tabs allow the skin panels to float vertically, that is, if the ice bin is shorter, the panel members will fit down further inside the base than if the ice bin is taller. The dispenser also includes middle trim strips 24, 28 and 32, for the left, right and rear panels respectively, and top trim strips 22, 26 and 30, for the left, right and rear panels respectively. Note that trim strips 22 and 24 for the left side panel, and trim strips 26 and 28 for the right side panel, have small corners 23, 25, 27, and 29 respectively, with an orifice for a locking tab. As mentioned above, the ice bin is preferably molded as a single piece of plastic, preferably with low thermal conductivity, so that the ice held therein will not melt.

The plastic may be any material, such as thermoplastic resins, suitable for rotational molding, also known as rotomolding, rotocasting or rotoforming. Plastics known to yield acceptable bins include polyethylene and polypropylene. With these materials, an ice bin having a wall thickness of up to about 0.125 inches (about 3 mm thick) may be rotomolded. The rotomolding process involves charging material to the mold and rotating the mold on two axes during molding. The rotomolding process uses tools that are much less expensive than those used in injection molding or blow molding, which could be used for making parts having walls about this thick. As a result, control over the finished dimensions of the product is typically limited to about 0.005" per inch of linear dimension of the finished product (about 0.12 mm per 25.4 mm of length). Thus, in a two-feet high ice bin, two-feet wide and one-and-a half feet deep, there may be dimensional variances of up to ±0.12", 0.12" and 0.09", respectively. In metric dimensions, the bin may be 610 mm×610 mm×458 mm, and the variances may be ±3 mm, 3 mm, and 2.3 mm respectively.

The resulting molded product tends to have well-formed skins and hollow walls. Such an article may be described as a "two-wall" molding. The inside of the hollow walls are then preferably injected with polyurethane foam to insulate the ice bin. The foam may have a density of 1.5 to 3.0 pounds per cubic foot, preferably from about 1.9 or 2.0 pounds per cubic foot to about 2.3 or 2.4 pounds per cubic foot. Other foam densities may also be useful, so long as the thermal conductivity of the foam is low. The walls of the ice bin are thus about 1⅛ to about 1¼" thick (about 28.5 mm to about 32 mm thick), separated by about ⅞ to 1" (about 22 mm to about 25 mm) and the center foam portion is thus about ⅞ to 1" thick (about 22 mm to about 25 mm thick).

While the overall dimensions of the ice bin may thus vary, there is much less variance over any particular portion of the ice bin. While the length of the ice bin may vary, the variation in length may be allowed for by supporting the side panels 16, 18 and rear panel 20 on the ice bin itself and by top lips on panels 16, 18 and 20. The lips on the panels may be seen in FIG. 6, and are more apparent in FIGS. 8–13. The base 12 allows for vertical "floating" of the side and rear panels up to about ±0.12" as stated above, since the panels will "float" in the length between the top of the base 12 and the bottom of the tabs 11 on the base. The left-right and front-back dimension variances may also be tolerated, in that the panels are oversized for the stated amount of variance. The skin panels are fastened at their top lips to the top of the ice bin walls with screws or other preferred fasteners. In this manner, the ice bin is manufactured by an inexpensive process with dimensional tolerances as stated.

An assembled, rear perspective view of the embodiment of FIG. 6 is shown in FIG. 7, with the ice bin 14 assembled with base 12, left panel 16 and rear panel 20, and trim strips 22, 24, 30 and 32. As shown in FIGS. 8–13, the panels and the trim strips include hooks that mate with the holes that make assembly and disassembly easy.

Figure 9:
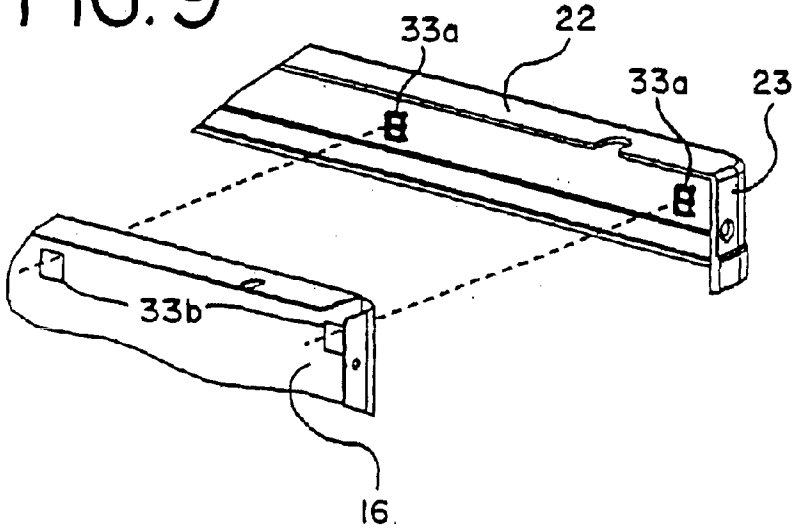
FIGS. 8–13 are close-up views of the trim components of the dispenser depicted in FIG. 5*a*.
Figure 10:
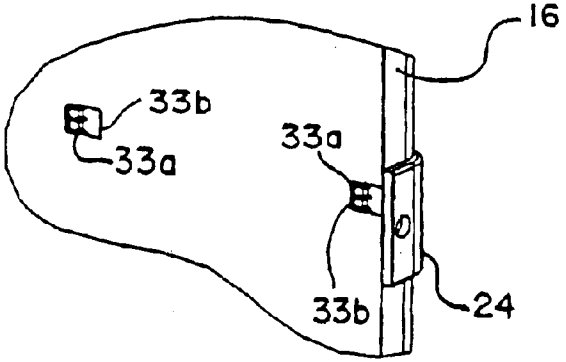
Figure 8:
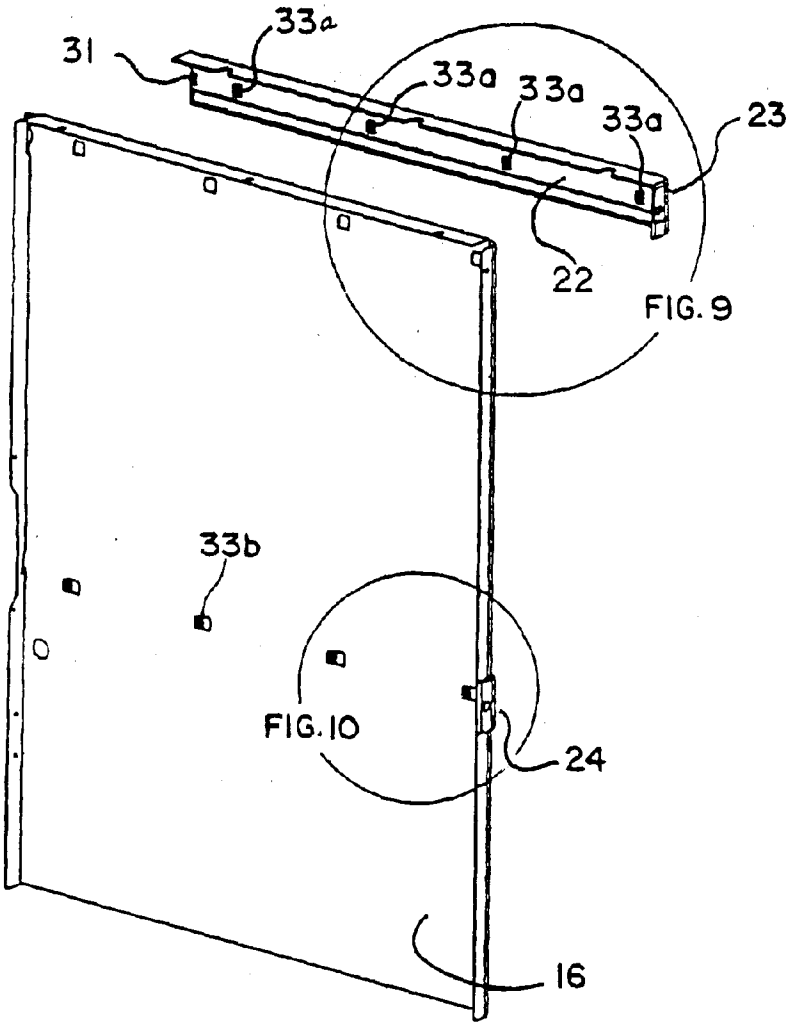

An inside view of left panel 16 depicts middle trim strip 24 assembled to the left panel 16 in FIG. 8, using hooks 33*a* and a locking tab 31 on trim strip 24 that fit into mating slots 33*b* on panel 16. FIG. 8 also depicts top trim strip 22 with corner 23 and a hole in the corner, approaching panel 16 for assembly, with its hooks 33*a* ready for engaging the slots 33*b* of panel 16. The approach of strip 22 to the slots 33*b* of panel 16 is shown in FIG. 9, with hooks 33*a* and locking tab 31 to hold the trim strip in place. The hooks 33*a* on the trim strip are inserted into the holes 33*b* and then slid to the left in FIG. 9. FIG. 10 shows middle trim strip 24 locked into place in panel 16 with hooks 33*a* and slots 33*b*. The trim strips on the right panel are assembled in a similar manner. The combined panel 16 and its trim strips is then screwed to the ice bin 14 via screws (not shown) in the top lip of the ice bin.

Figure 12:
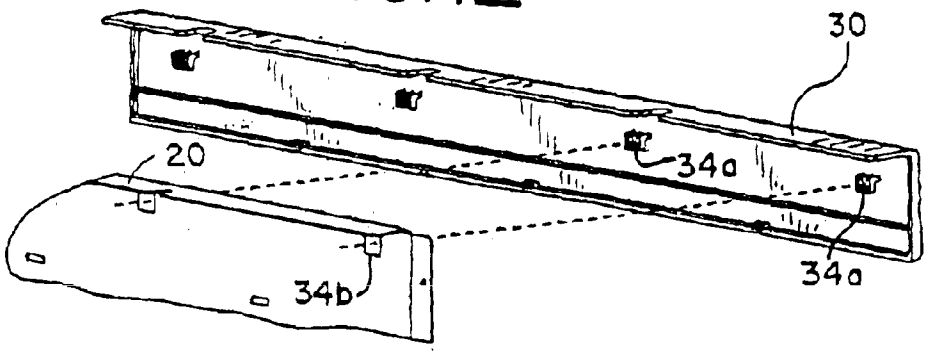
Figure 13:
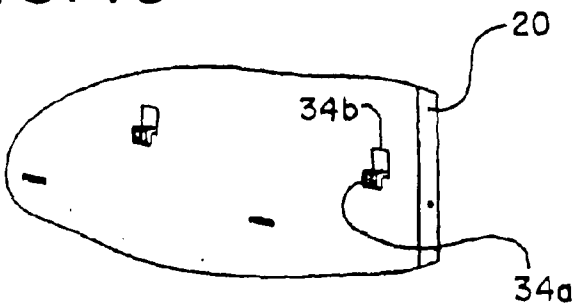
Figure 11:
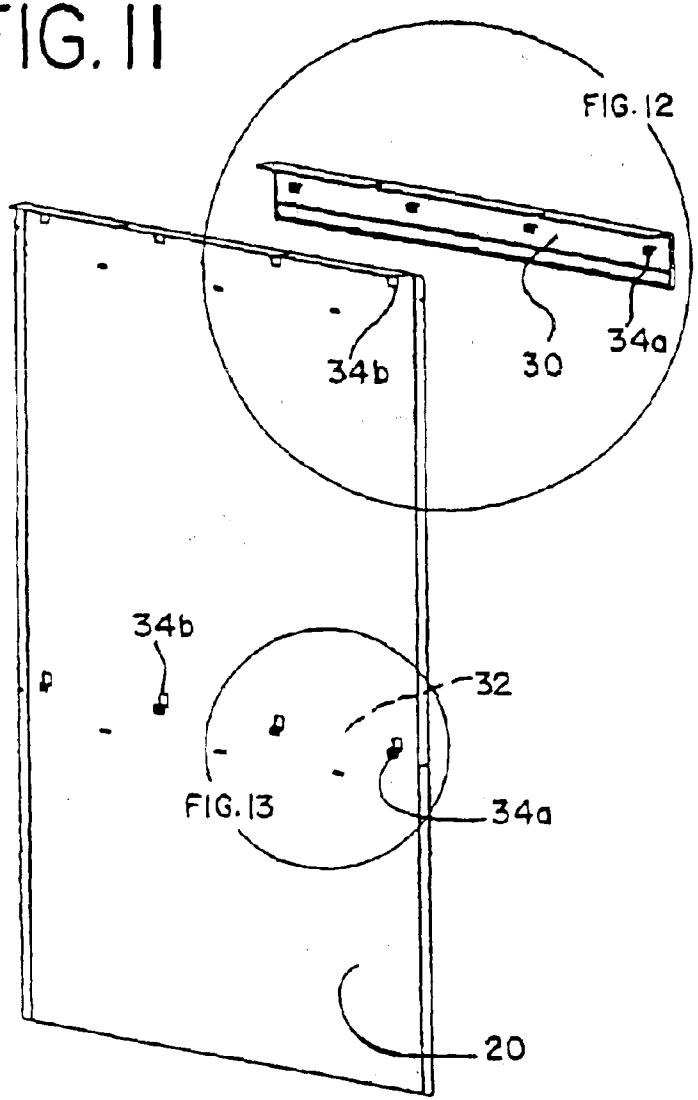

Rear panel 20 is assembled with middle trim strip 32 by hooks 34*a* fit into slots 34*b* of the rear panel 20, as shown in FIG. 11. Top trim strip 30 with hooks 34*a* on its inner side is ready for placement onto panel 20. The details of the hooks 34*a* on trim strip 30 as the strip approaches slots 34*b* in rear panel 20 for assembly are shown in FIG. 12. The trim strip is inserted and pressed downward to engage the hooks 34*a* into the slots 34*b* of the rear panel 20, as shown in FIG. 13, which shows hooks 34*a* of middle trim strip 32 locked into place in the slots 34*b* of rear panel 20. Note that the trim strips 30 and 32 for the rear panel do not have "corners" with a slot for a locking tab, as do the trim strips for the left and right panels. The rear panel 20 is assembled to the ice bin with screws (not shown) through the top lip of the ice bin.

Figure 14A:
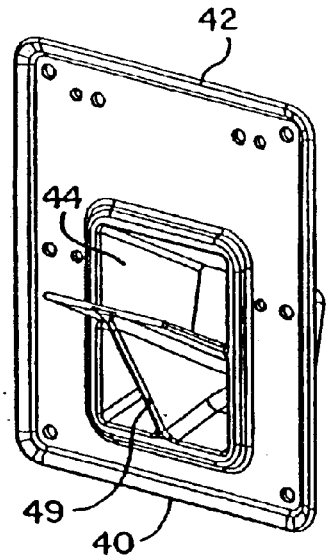
FIGS. 14*a* and 14*b* are perspective views of an ice chute used in preferred embodiments of the dispensers of FIGS. 1, 4 and 5*a*.
Figure 14B:
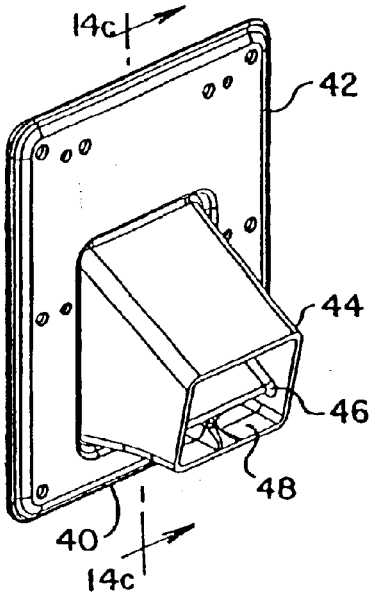
Figure 14C:
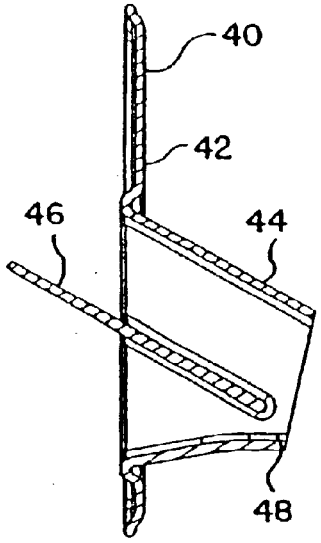
FIG. 14*c* is a cross-sectional view of the ice chute of FIGS. 14*a* and 14*b*.

An ice chute 40, best seen in FIGS. 14*a* and 14*b*, is mounted to the front of the ice bin, as used in all the foregoing dispenser embodiments. The ice chute 40 includes a mounting panel 42 and a protruding, downward sloping chute 44. The downward-sloping chute 44 also includes an intermediate surface 46 between the top and bottom of the chute. Intermediate surface 46 is inclined downward and ends inside the chute, so that any melted water will drip onto lower surface 48 and drain back into the ice bin. Reinforcing gusset 49 adds stability to the chute and helps prevent ice from leaving via the lower part of the chute. FIG. 14*c* shows this same embodiment of ice chute in cross-section, so that the relationship of the surfaces to each other may be appreciated. When the chute is not in use, water that melts and trickles down surface 46 will also flow onto surface 48 and drain back into the ice bin, thus eliminating water dripping from the chute.

Figure 15:
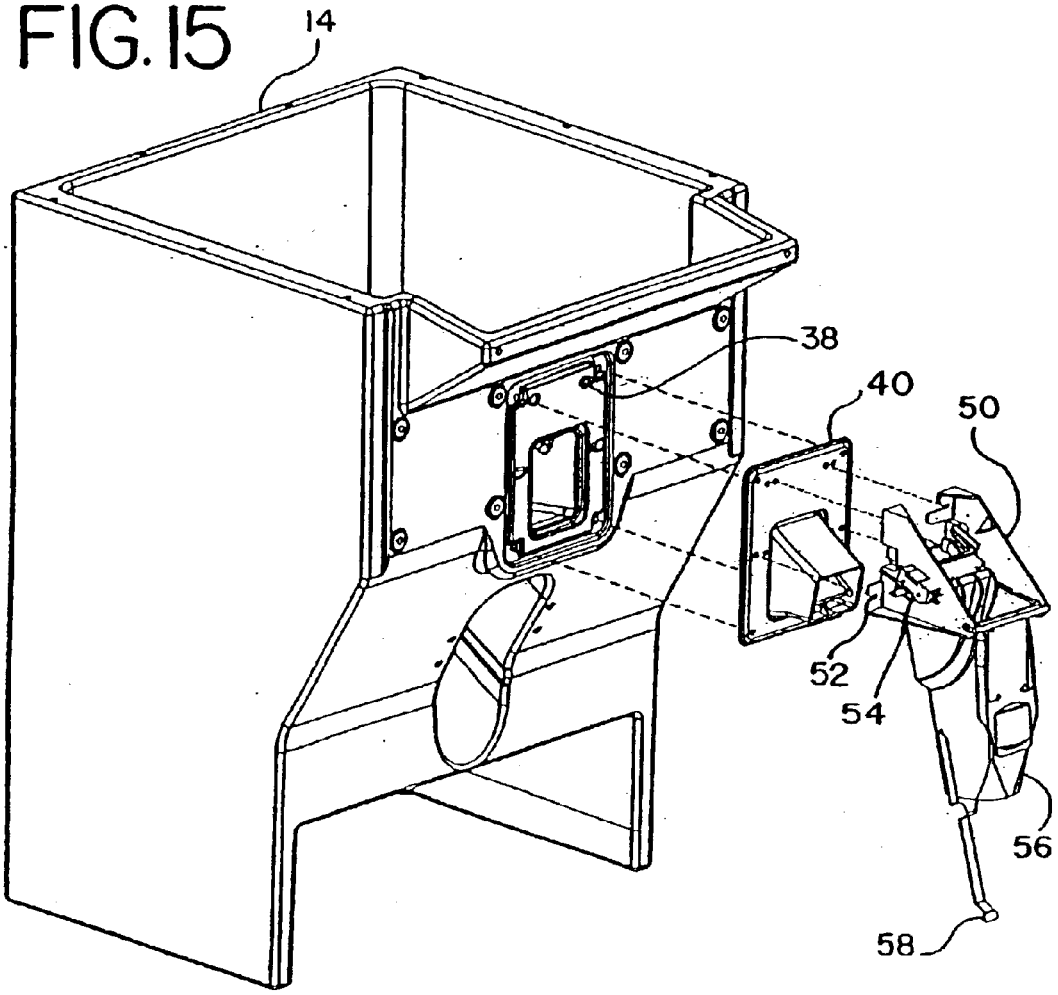
FIG. 15 is an exploded view of the ice chute and bin assembly of the dispensers of FIGS. 1, 4 and 5*a*.

A front perspective view of the ice bin 14 is shown in FIG. 15, with the ice chute 40 and rocking chute 50 ready for assembly to the ice bin. The ice chute 40 mounts to a boss 38 molded into the ice bin. The rocking chute 50 then mounts to the ice chute as shown. The rocking chute is the customer interface for the ice dispenser. The rocking chute may be made according to the disclosure of U.S. Pat. No. 5,437,391, assigned to the assignee of the present application, and incorporated by reference herein. The rocking chute has mounting slots 52 for mounting to the ice chute, and also has a microswitch 54, an ice passage 56 and a sanitary or actuating lever 58. When a customer presses the lever 58, the microswitch 54 actuates a motor 74 and dispensing mechanism (see FIG. 16) to dispense ice into a cup or container presented by the customer below the ice passage. Some rocking chutes may not use a lever 58 and are actuated instead by pushing on the chute 56 itself.

Figure 16:
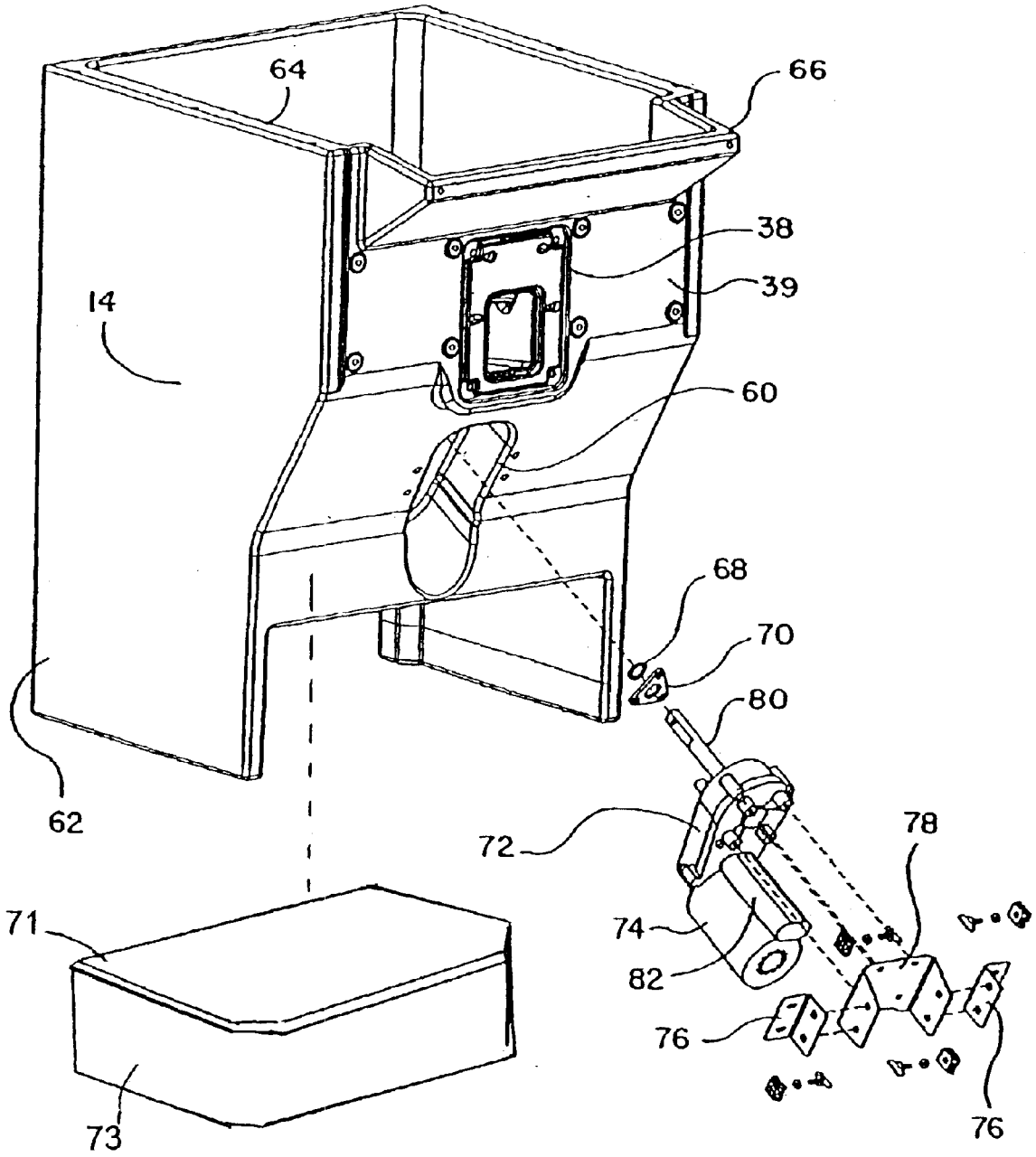
FIG. 16 is an exploded view of the motor and bin assembly of the dispenser of FIGS. 1, 4, and 5*a*.

As shown in FIG. 16, the ice bin 14 has an outer wall 62 and an inner wall 64, and may also have a frontal extension 66. Frontal extension 66 makes it easier for manual loading of ice into the ice bin. In addition to the ice chute mounting boss 38, the ice bin 14 also has a lighting assembly mounting boss 39 and a motor mount recess 60. Motor mount recess 60 may be a recess providing access into the interior of the ice bin, for a paddle wheel and agitator moved by a motor 74. The motor may be a gear motor. Motor 74 also includes start capacitor 82 and gear train 72 for slowing the speed of the output shaft 80. Motor 74 mounts inside the recess 60 through brackets 76 and motor mount 78. The motor assembly includes seal 68 and seal retainer 70. Quick clips and wing bolts are used for very fast assembly and disassembly. In instances where only an ice dispenser is desired, there is no cold plate in the dispenser. Instead, a plastic tray 71 is inserted along with a layer of foam 73 to occupy the space otherwise occupied by the cold plate. The tray may be any desired thickness or material, but trays made from about ⅛" of polyethylene or other thermoplastic material may be used.

Figure 17:
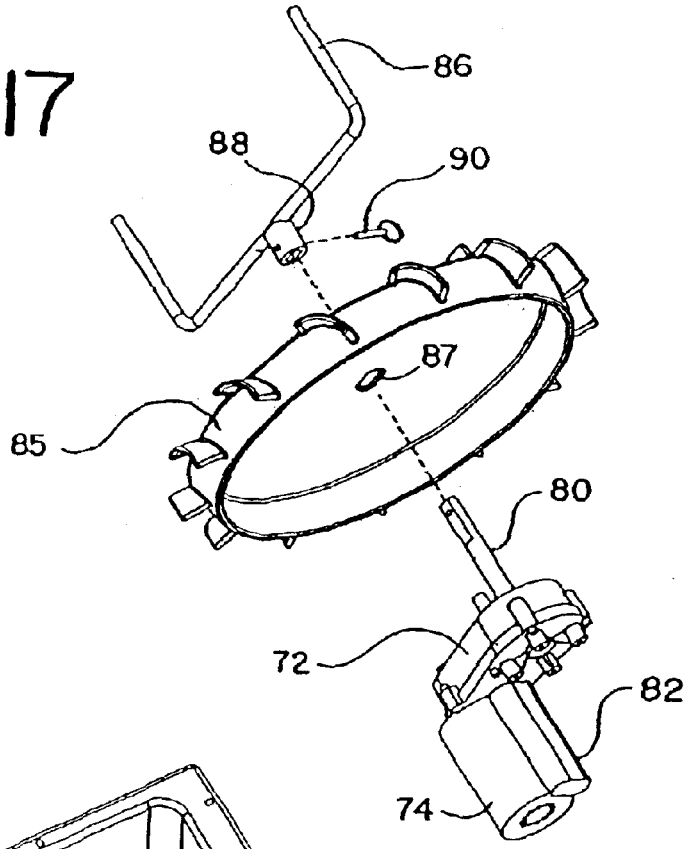
FIG. 17 is an exploded view of the motor, paddle wheel and agitator used in the dispensers of FIGS. 1, 4, and 5*a*.
Figure 18:
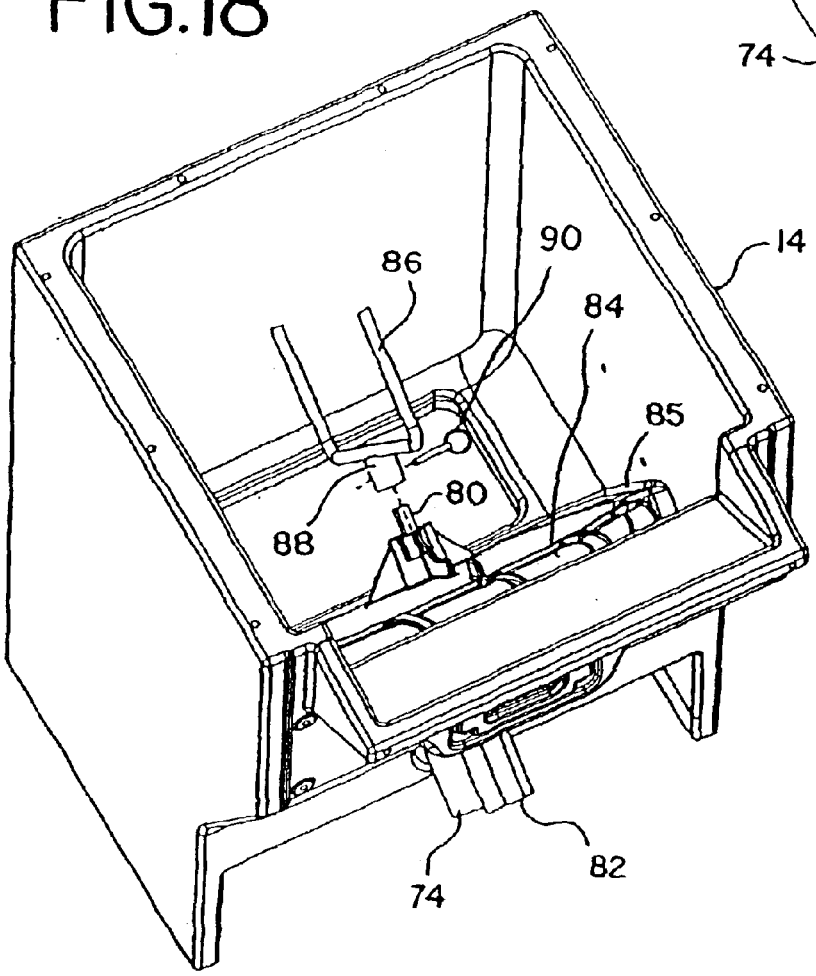
FIG. 18 is a perspective view of the assembled ice bin and motor/agitator/paddle wheel assembly used in the dispensers of FIGS. 1, 4, and 5*a*.

FIG. 17 is an exploded view of the gear motor assembly, paddle wheel 85, agitator 86 with shaft mount 88 and pin 90, used in the dispensers 10, 110, 210 and 310. The gear motor assembly includes gear motor 74, start capacitor 82 and gear train 72 and shaft 80. Output shaft 80 has two flats on opposite sides of the shaft. These flats mate with flats in shaft mount 88 and paddle wheel interface 87, so that the flats provide the driving force to rotate both the paddle wheel and the agitator, which rotate at the same speed. Shaft 80 and agitator shaft mount 88 have orifices for insertion of an assembly pin 90. Note that in this configuration, torque from the motor is transmitted through the flats of the shaft 80, the paddlewheel interface 87, and the shaft mount 88. Torque is not transmitted through the mounting pin 90, which serves merely as a restraint against axial shaft movement. A top perspective view of the ice bin 14 and motor 74 and capacitor 82 assembled into the ice bin is shown in FIG. 18. Paddlewheel 85 mounts into mounting boss 84 on the inside of the ice bin. FIG. 18 also details how the agitator 86 is assembled to shaft 80 with shaft mount 88 and pin 90.

Figure 19:
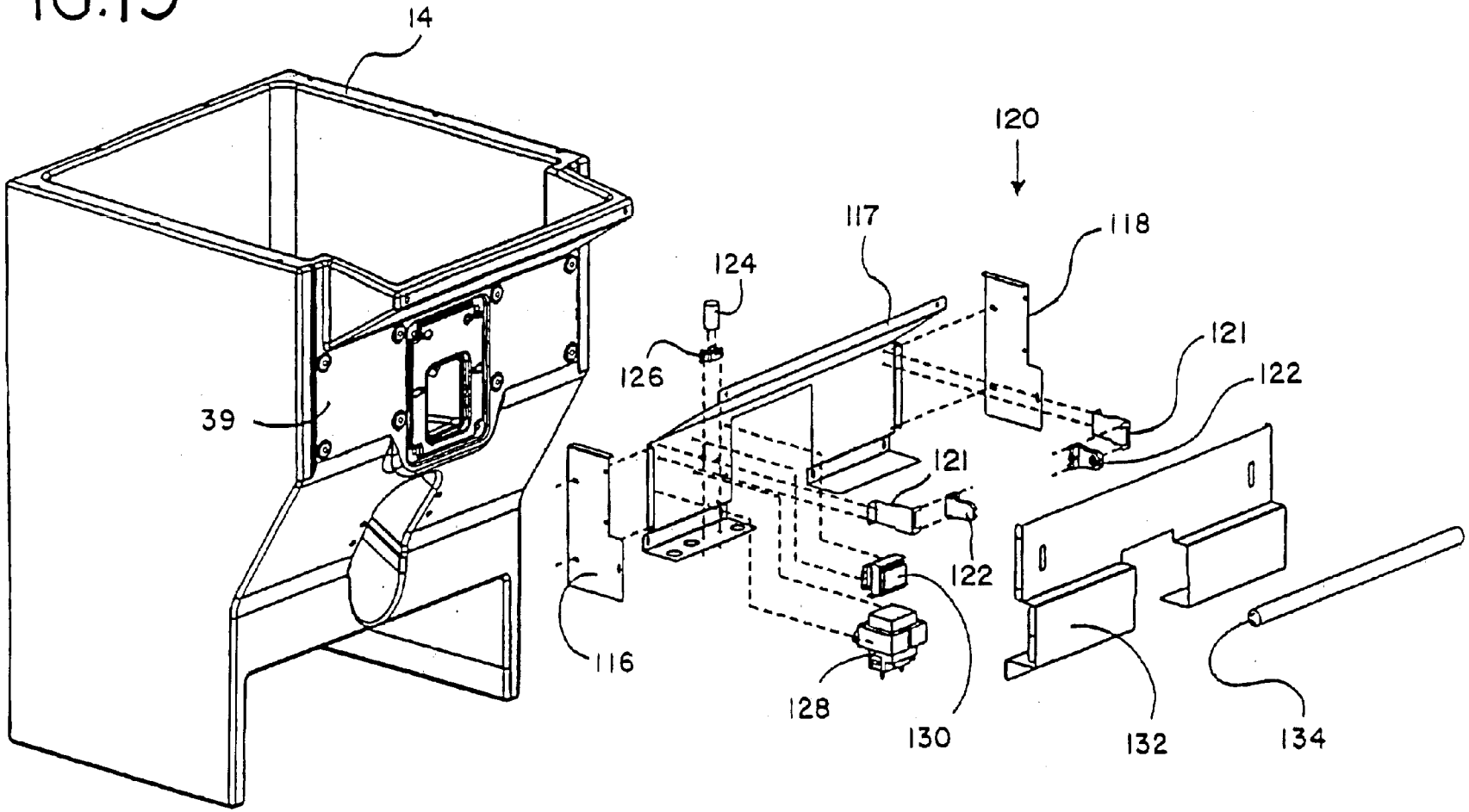
FIG. 19 is an exploded view of the base of the electrical and lighting assembly used in the dispensers of FIGS. 1, 4, and 5*a*.

A light and electrical assembly 120 may be used in several embodiments of the ice or ice/beverage dispenser. As shown in FIGS. 4 and 19, the lighting and electrical assembly 120 may be mounted to the lighting assembly mounting boss 39 of ice bin 14. The lighting assembly 120 mounts to the mounting boss with mounting plate 117 and left and right side mounting brackets 116, 118. The lamp 134 is secured with light mounting brackets 121 and socket ends 122. Transformer/breaker 128, ballast 130 and starter 124 provide power for the lamp. Starter 124 is mounted in starter base 126. Light from lamp 134 is deflected from light deflector 132 toward the front of the ice dispenser. The transformer may also supply electricity to the valves 160, a timer for timing ice agitation (not shown), and other electrical options.

Figure 20:
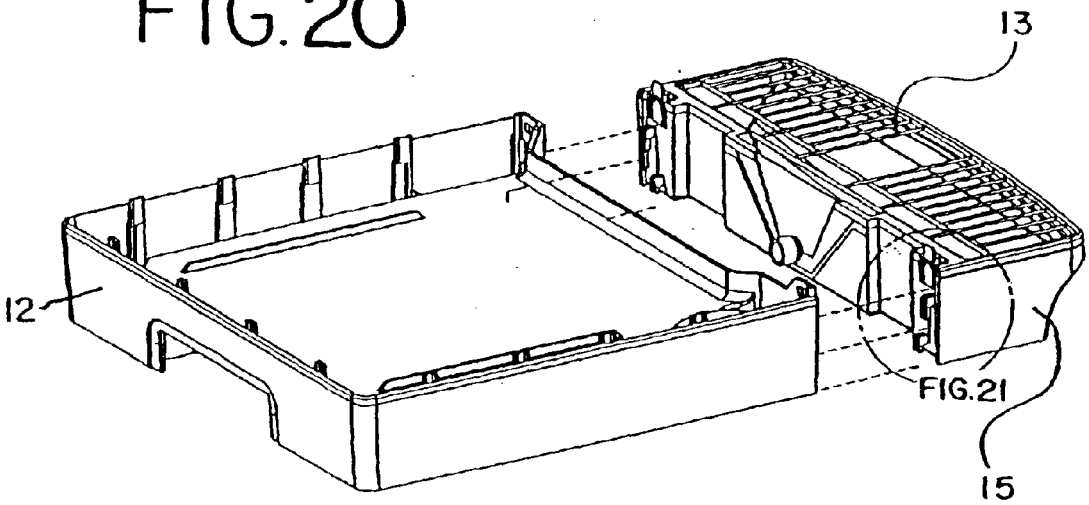
FIG. 20 is an exploded view of the base and drain pan assembly used in the dispensers of FIGS. 1, 4, and 5*a*.
Figure 21:
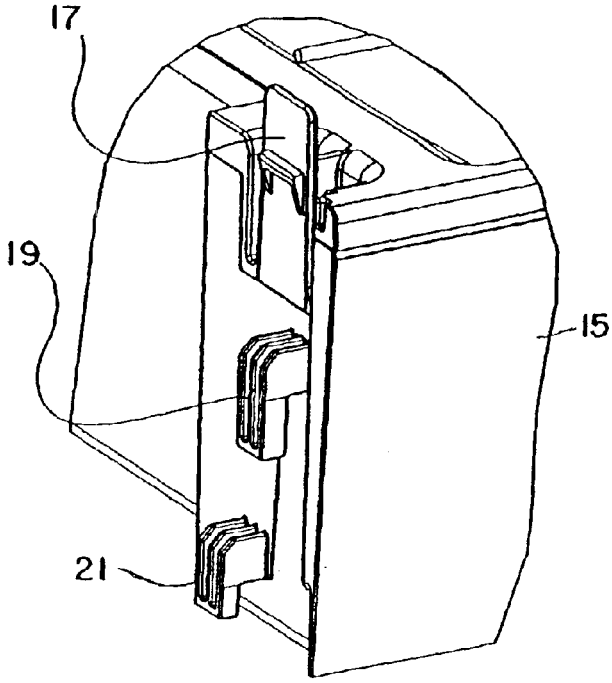
FIG. 21 is a close-up view of engagement hooks and locking tab of the drain pan assembly of FIG. 20.

Grid 13 and drain pan 15 mounted to base 12, as shown in FIGS. 20 and 21, is used in dispensers 10, 110, 210 and 310. FIG. 21 shows details of the drain pan, including an integral features, such as locking tab 17 and mounting hooks 19, 21, for removably assembling drain pan 15 to the base 12. It will be recognized by those skilled in the art that the integral mounting features could also be on the base 12 for mounting to the drain pan.

Figure 22:
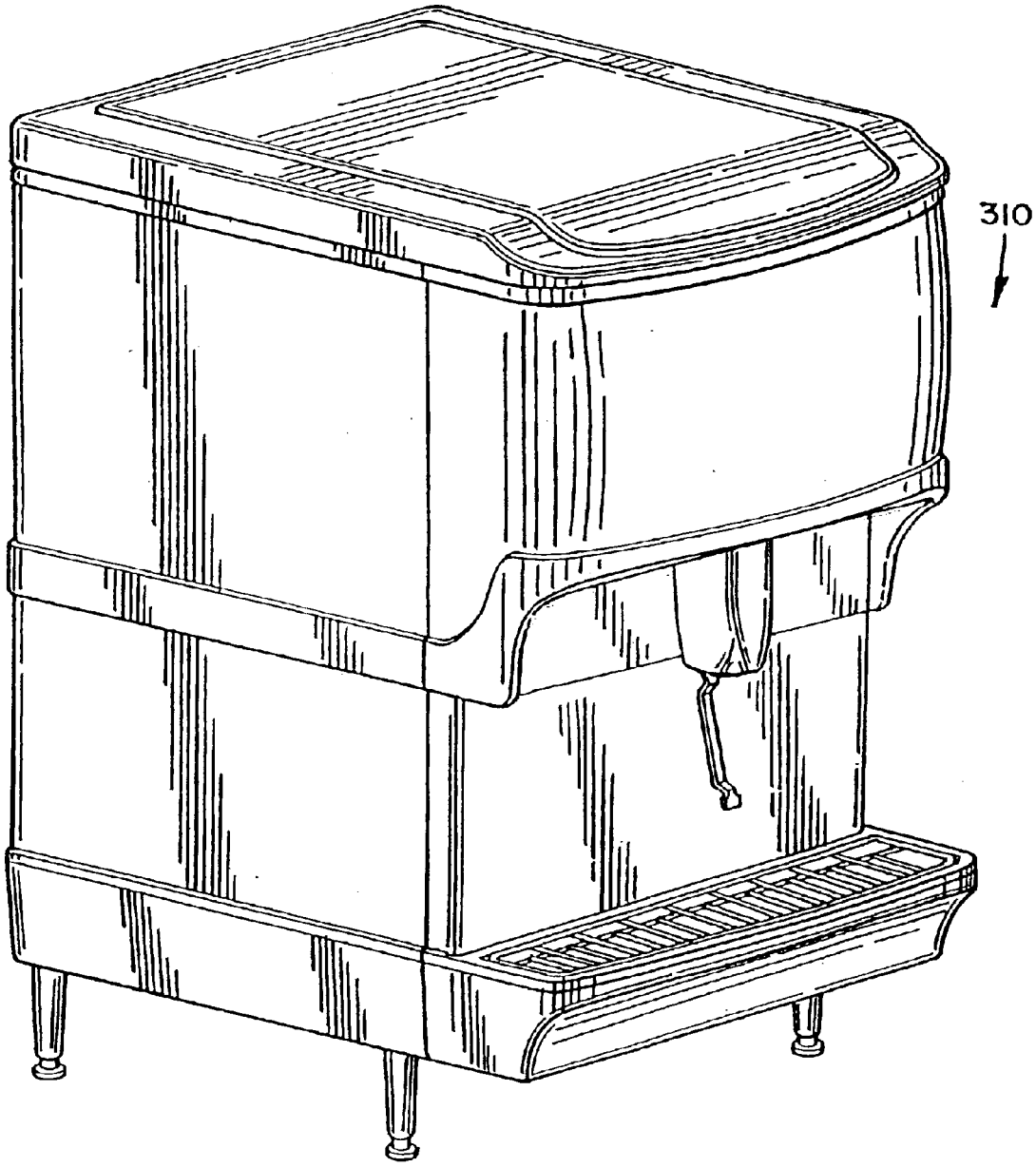
FIG. 22 is a perspective view of a second embodiment of an ice dispenser of the present invention.

There are many ways to practice the invention. While the ice dispensers and ice and beverage dispensers of the present invention are primarily intended for countertop use, they could be mounted on a floor or other low surface where the location may be more convenient. Yet another embodiment of the invention is an ice-only dispenser 310, as shown in FIG. 22. This embodiment will not include a cold plate, beverage component coils, or carbonator of the embodiments previously described. Dispenser 310 includes an ice bin 14, detachable housing panels, rocking chute (as shown) and ice chute for dispensing ice. Yet another embodiment may include an ice maker 175 as shown in FIG. 5*b*.

One advantage of the preferred ice dispensers and ice/beverage dispenser embodiments of the present invention is that they may be disassembled for repair or cleaning. As noted above, the trim strips detachably mount to the housing panels and the housing panels mount to the ice bin with fasteners. If a housing panel is scratched or dented, or otherwise is in need or repair, the ice or ice beverage dispenser may be easily disassembled by removing the trim strips and backing out the fasteners to remove the sheet metal housing panels. The individual panels or other component in need of repair is then repaired or replaced. Of course, if such facile disassembly is not desired, it is possible to assemble the components so that they cannot be easily disassembled. That is, adhesives or rivets may be used in place of removable fasteners to adhere the outer housing panels to the ice bin. In other embodiments, if additional insulative foam is assembled between the housing panels and the ice bin, the foam may be permanently mounted to the ice bin and to the housing panels with adhesives. These adhesives should be food-grade adhesives approved by the Food and Drug Administration for at least incidental food contact.

One advantage of the preferred embodiments of the invention is that the base for the dispensers is plastic, and will not scratch or mar countertops. However, it is possible to add legs or supports to the dispensers. In other applications, the base may be sealed or mounted to the countertop to prevent ingress of debris, food particles, beverages or water underneath the dispenser. An ice dispenser or ice/beverage dispenser according to some embodiments of the present invention can be sealed to a countertop by its base. It can be disassembled in place by ready removal of all the upper features, leaving only the base (and the drain pan if it is also sealed).

Other advantages lie in the configuration of the ice bin, which is preferably molded as a single piece of plastic. The plastic for the single-piece ice bin is preferably of a thermally insulative nature, and the plastic should be strong enough for general, commercial use with high resistance to thermal conductivity. In addition, the ice bin may be molded with recesses for an ice paddlewheel and for an agitator-motor. These recesses not only make assembly easier, they also act as bosses to reinforce the sides of the ice bin where they are placed. Thus, the sides of the bin are reinforced where there are mechanical or vibration loads, where reinforcement is needed. Finally, the dispenser is designed for easy assembly and therefore easy disassembly, so that it may be repaired or parts replaced as needed, rather than having to replace the entire dispenser when it is damaged.

The preferred ice bin according to the present invention is manufactured in a single piece with hollow walls by a rotomolding process, foam is injected into the hollow walls, and the skin panels are then attached. The advantage of these separate manufacturing processes is that the ice bin may be assembled and disassembled without the disadvantages of a foamed-in-place ice bin. The rotomolding process thus yields not only a monolithic, single-piece plastic ice bin, but an ice bin which also has hollow walls. A monolithic plastic ice bin is defined here as an ice bin which has no seams or joint. A monolithic ice bin will preferably be made by a process such as injection molding, rotocasting, thermoforming, or rotomolding. A single piece plastic ice bin is one which is monolithic or which is formed from two or more pieces that are then joined permanently. Processes that can make a single piece plastic ice bin would include all process for making monolithic plastic ice bins, as noted, and also processes such as welding or permanently adhering plastic pieces. By comparison, prior art ice bins have been made by molding individual pieces and reversibly assembling the pieces with special edge joints and seals to maintain integrity and sanitation, as revealed in U.S. Pat. No. 5,797,514.

The ice bin may be formed by other processes, and subsequently assembled into the dispenser. Alternate processes may include thermoforming of plastics or welding of plastic pieces to form a single-piece ice bin. A single-piece ice bin may also be molded via a spray-up process, a compression molding process, blow-molding, or even an injection molding process, any of which are likely far more expensive than rotomolding, but which processes will yield a highly desirable, single piece ice bin. It is also possible to form a single piece ice bin by a process known as reaction injection molding (RIM) in which two chemical streams are combined and mixed in a tool to form a molded product. In some embodiments of the invention, the ice bin may be other than a single piece of plastic, but may still comprise hollow walls into which foam insulation is injected.

Similar materials, such as those used for foaming-in-place, may also be used to form or mold a single-piece ice bin separately from assembly of the other components, thus making disassembly possible as well as easy. All these embodiments are meant to be included in the present invention. If foam is used to insulate the cold plate and the ice bin from the outer housing panels, the foam preferably will be easily separable or removable from the cold plate and the ice bin, so that the ice and beverage dispenser can be easily disassembled for refurbishment and repairs.

Accordingly, it is the intention of the applicants to protect all variations and modifications within the valid scope of the claims. It is intended that the invention be defined by the following claims, including all equivalents. While the invention has been described with reference to particular embodiments, those of skill in the art will recognize modifications of structure, materials, procedure and the like that will fall within the scope of the invention and the following claims.

What is claimed is:

1. An ice and beverage dispenser, comprising:

a) a single-piece plastic ice bin;

b) a housing mounted to the ice bin;

c) an agitator and motor for agitating ice within the ice bin;

d) an ice chute mounted to the ice bin;

e) a cold plate mounted under the ice bin, the cold plate having a plurality of beverage component coils for heat exchange with ice;

f) a plurality of dispensing valves in fluid communication with the beverage component coils for dispensing a beverage; and g) a paddle wheel mounted inside the ice bin and operably connected to the motor, wherein the paddle wheel and the agitator both mount to flats on a shaft of the motor and wherein the paddle wheel and agitator may be removed from the dispenser by removing a single pin.

2. The dispenser of claim 1 wherein the housing comprises a base, a rear panel and side panels that detachably mount to the base, and a top.

3. A combination of die dispenser of claim 1 and an ice-making machine mounted on top or the ice bin.

4. The dispenser of claim 1 wherein the ice bin is manufactured by a process selected from the group consisting of rotomolding, blow molding, thermoforming, injection molding, and reaction injecting molding (RIM).

5. The dispenser of claim 1 further comprising a rocking chute mounted to the ice chute.

6. The dispenser of claim 1 further comprising a carbonator operably connected to the cold plate.

7. The dispenser of claim 2 further comprising trim strips that detachably mount to the rear and side panels and a drain assembly that detachably mounts to the base.

8. The dispenser of claim 1 further comprising a manifold between the beverage component coils and the dispensing valves, said manifold enabling a delivery selection of non-carbonated water or carbonated water to each valve.

9. The dispenser of claim 1 wherein the ice chute further comprises a reverse chute for channeling melted water to the ice bin.

10. The dispenser of claim 1 further comprising a light assembly and a front fascia detachably mounted to a front of the dispenser.

11. The dispenser of claim 2 further comprising legs mounted to the base.

12. The dispenser or claim 1 wherein the ice bin further comprises a recess for mounting the motor.

13. The dispenser of claim 1 further comprising a plastic base and drain pan that mount detachably with integral features.

14. An ice and beverage dispenser, comprising:

a) a single-piece plastic ice bin;

b) a housing mounted to the ice bin;

c) an agitator and motor for agitating ice within the ice bin;

d) an ice chute mounted to the ice bin;

e) a cold plate mounted under the ice bin, the cold plate having a plurality of beverage component coils for heat exchange with ice;

f) a plurality of dispensing valves in fluid communication with the beverage component coils for dispensing a beverage; and g) a plastic base and drain pan that mount detachably with integral features.

15. The dispenser of claim 14 wherein the housing comprises a base, a rear panel and side panels that detachably mount to the base, and a top.

16. A combination of the dispenser of claim 14 and an ice-making machine mounted on top of the ice bin.

17. The dispenser of claim 14 further comprising a paddle wheel mounted inside the ice bin and operably connected to the motor, wherein the paddle wheel and the agitator both mount to flats on a shaft of the motor and wherein the paddle wheel and agitator may be removed from the dispenser by removing a single pin.

18. The dispenser of claim 14 wherein the ice bin is manufactured by a process selected from the group consisting of rotomolding, blow molding, thermoforming, injection molding, and reaction injecting molding (RIM).

19. The dispenser of claim 14 further comprising a carbonator operably connected to the cold plate.

20. The dispenser of claim 15 further comprising trim strips that detachably mount to the rear and side panels and a drain assembly that detachably mounts to the base.

21. The dispenser of claim 14 further comprising a manifold between the beverage component coils and the dispensing valves, said manifold enable a delivery selection of non-carbonated water or carbonated water to each valve.

22. The dispenser of claim 14 wherein the ice chute further comprises a reverse chute for channeling melted water to the ice bin.

23. The dispenser of claim 14 further comprising a light assembly and a front fascia detachably mounted to a front of the dispenser.

24. The dispenser of claim 15 further comprising legs mounted to the base.

25. The dispenser of claim 14 wherein the ice bin further comprises a recess for mounting the motor.

26. The dispenser of claim 14 further comprising a rocking chute mounted to the ice chute.

27. An ice and beverage dispenser, comprising:

a) a single-piece plastic ice bin;

b) a housing mounted to the ice bin;

c) an agitator and motor for agitating ice within the ice bin;

d) an ice chute mounted to the ice bin;

e) a cold plate mounted under the ice bin, the cold plate having a plurality of beverage component coils for heat exchange with ice;

f) a plurality of dispensing valves in fluid communication with the beverage component coils for dispensing a beverage; and g) a reverse chute for channeling melted water to the ice bin.

28. An ice and beverage dispenser, comprising:

a) a single-piece plastic ice bin;

b) a housing mounted to the ice bin;

c) an agitator and motor for agitating ice within the ice bin;

d) an ice chute mounted to the ice bin;

e) a cold plate mounted under the ice bin, the cold plate having a plurality of beverage component coils for heat exchange with ice;

f) a plurality of dispensing valves in fluid communication with the beverage component coils for dispensing a beverage; and g) a rocking chute mounted to the ice chute.

29. An ice and beverage dispenser, comprising:

a) a single-piece plastic ice bin;

b) a housing mounted to the ice bin, the housing comprising a base, a rear panel and side panels that detachably mount to the base, and at top;

c) an agitator and motor for agitating ice within the ice bin;

d) an ice chute mounted to the ice bin;

e) a cold plate mounted under the ice bin, the cold plate having at plurality of beverage component coils for heat exchange with ice;

f) a plurality of dispensing valves in fluid communication with the beverage component coils for dispensing a beverage; and h) trim strips that mount detachably to the rear and side panels and a drain assembly that detachably mounts to the base.

* * * * *

UNITED STATES PATENT AND TRADEMARK OFFICE

CERTIFICATE OF CORRECTION

PATENT NO. : 6,880,358 B2
APPLICATION NO. : 10/389681
DATED : April 19, 2005
INVENTOR(S) : Alan S. Lucas et al.

It is certified that error appears in the above-identified patent and that said Letters Patent is hereby corrected as shown below:

In the Claims

Column 11, in claim 3, line 1, after "combination of" delete "die" and substitute --the-- in its place.

Column 11, in claim 3, line 2, after "mounted on top" delete "or" and substitute --of-- in its place.

Column 12, in claim 21, line 3, after "said manifold" delete "enable" and substitute --enabling-- in its place.

Signed and Sealed this

Twenty-ninth Day of April, 2008

JON W. DUDAS
*Director of the United States Patent and Trademark Office*